United States Patent [19]

Kleiner

[11] Patent Number: 4,552,184

[45] Date of Patent: Nov. 12, 1985

[54] METHOD AND APPARATUS FOR CONTROLLING A ROTATION DOBBY

[75] Inventor: Walter Kleiner, Hirzel-Zurich, Switzerland

[73] Assignee: Staeubli Ltd., Zurich, Switzerland

[21] Appl. No.: 557,765

[22] Filed: Dec. 2, 1983

[30] Foreign Application Priority Data

Dec. 22, 1982 [CH] Switzerland ..... 7479/82

[51] Int. Cl.[4] ..... D03C 1/00

[52] U.S. Cl. ..... 139/66 R; 139/68; 139/76

[58] Field of Search ..... 139/76, 66 R, 68, 331

[56] References Cited

U.S. PATENT DOCUMENTS

| | | | |
|---|---|---|---|
| 3,180,366 | 4/1965 | Hoenig | 139/66 R |
| 3,724,511 | 4/1973 | Kleiner . | |
| 3,730,231 | 5/1973 | Hoenig . | |
| 4,000,761 | 1/1977 | Kleiner . | |
| 4,154,268 | 5/1979 | Schwarz . | |
| 4,301,905 | 11/1981 | Brock et al. | 139/66 R |
| 4,354,531 | 10/1982 | Surkamp et al. | 139/66 R |
| 4,367,770 | 1/1983 | Schwarz | 139/66 R |
| 4,371,006 | 2/1983 | Schwarz . | |

FOREIGN PATENT DOCUMENTS 621157 1/1981 Switzerland .

*Primary Examiner*—James Kee Chi

*Attorney, Agent, or Firm*—Flynn, Thiel, Boutell & Tanis

[57] ABSTRACT

A dobby includes a needle mechanism having a reading needle, the head of which, during reading of a nonperforated location on a pattern card, engages a pawl and, during reading of a hole in the card, releases the pawl to permit the pawl, under the force of a spring, to tilt about an axle and in this manner to have a surface thereof disposed in front of an edge of a key-shifting gate. During the operating movement of the axle, the pawl pushes the key-shifting gate, which slides in rectilinear guides, wherein a key is carried along by a cam which encircles the opening for the shaft 1. The key is radially movably supported on the eccentric ring and engages one of two openings on the connecting rod, which results in a standstill of the heddle frame, or engages one of two grooves in the drive shaft. In the latter case, the drive shaft carries the key and the eccentric ring along as it rotates and moves the connecting rod, which triggers a movement of the heddle frame. The key is thus moved in a direction which is reversed with respect to the direction of movement of the reading needle by means of the pawl, which serves as a power-amplifying member.

12 Claims, 6 Drawing Figures

METHOD AND APPARATUS FOR CONTROLLING A ROTATION DOBBY

FIELD OF THE INVENTION

This invention relates to a rotation dobby and, more particularly, to a method and apparatus for controlling a dobby including a drive shaft having two axially extending grooves and on which is rotatably supported an eccentric ring with a radially movable control key, a connecting rod which is rotatably supported on the eccentric ring, has two diametrically opposed locking openings for the control key, and is operatively coupled to a heddle frame, a needle mechanism which includes a member adapted to read a pattern card and which controls an operating lever which can move a key-shifting gate, the key-shifting gate having an opening and having a collar around the periphery of the opening which cooperates with the key.

BACKGROUND OF THE INVENTION

Such rotation dobbies are known. In particular, U.S. Pat. Nos. 3,724,511 and 3,730,231 each disclose such a dobby. Both designs have a key-shafting gate as a control member, wherein the main shaft of the dobby extends through an opening in the gate and the gate for transmitting control impulses to the key carries out a swivelling movement about a fixed axis. The opening in the gear-shifting gate has a collar which projects axially with respect to the main shaft and serves as an endless cam which is constantly in engagement with a groove in the key.

Due to the small thickness of the key-shifting gate, which is possible due to the heddle frame thickness, the key-shifting gate is exposed to relatively strong bending and torsion forces. Since the shaft for the swingable support and the connecting point to the needle mechanism lie, due to the narrow heddle frame thickness, relatively far outside the range of movement of the connecting rod, the switching arm must be built very strong in order to prevent warping, bends and spring action, which requires a heavy construction and results in a certain movement inertia or, through unexpected lateral friction, misfunctions of the machine.

A first purpose of the invention is an increase in the machine speed by providing a change in the support and control of the switching arm.

Reading systems have become known, for example through U.S. Pat. No. 4,154,268, in which the pattern-like control is transmitted through a power amplifier to a shed-forming mechanism of the Hattersley system, whereby the main characteristics include the power amplifier moving the reading needle toward the pattern card and thus starting the reading operation and also moving in a power-amplifying manner the control mechanism for the heddle-frame operating members, the power-amplifying movement being in the same direction as the movement of the reading needle.

In the embodiment according to U.S. Pat. No. 4,371,006, the power amplifier acts only when a different reading value is read by the reading needle from the pattern card. The return of the control parts is done by the power amplifier. In the embodiment according to U.S. Pat. No. 4,385,646, the power amplifier acts only when the reading needle encounters a perforation in the pattern card. A return spring is provided for returning the control parts. Both designs have the characteristic that, during reading of a hole of the pattern card by the reading needle, the heddle frame is moved into the upper-shed position or remains unmoved. Both designs were illustrated and described in connection with the control of the draw hooks of a dobby of the Hattersley system. However, it is also possible to use these systems for controlling the locking keys of a dobby with a rotation drive. The purpose remains the same. It is necessary only to provide a suitable connection to the controlled member, such as a draw hook, control key, etc.

A purpose of the invention is thus to provide a needle mechanism for a rotation machine such that the transfer of the reading value is transmitted in a power-amplified manner in a direction which is opposite to the direction of movement of the reading needle, wherein reversing levers for the control movement, as is for example the case in Swiss Patent No. 621 157, are not required.

SUMMARY OF THE INVENTION

This purpose is attained by a method of operating a dobby of the specified type which includes the steps of providing a power-amplifying member between the reading mechanism and the control position of the control key, the direction of operation of the power amplifying member being different from and preferably opposite to the direction of movement of the reading needle so it reads the pattern card. An apparatus for operating a dobby of the specified type includes the key-shifting gate being supported in a rectilinear sliding guide for movement radially of the drive shaft.

In a preferred embodiment of the invention, the operating member is constructed as a pawl which is pivotal about an axle extending transversely to its direction of operational movement, wherein the operating movement direction corresponds with the guide direction of the key-shifting gate. The pawl has an inclined surface which is provided in the region of movement of the reading needle, through which it can be moved into and out of engagement with the key-shifting gate by the reading needle. Since during reading of the pattern card the operating movement of the pawl occurs in a direction opposite the direction of movement of the reading needle, there results the desired reversal of the control direction for the rotation drive of a dobby.

Before ending a reading movement in which the reading needle moves into a hole in the pattern card, it moves the pawl from an ineffective position into an effective position. At the same time, or after a slight delay, the pawl is moved in a power-amplifying sense in the direction which is opposite to the direction of the reading movement of the needle, and the control member, which can be a draw hook of a Hattersley system or the switching arm of a rotation dobby, is thereby driven. For this purpose, the needle and pawl are constructed so that the needle, during the automatic movement back out of the hole in the pattern card, deflects the pawl into its ineffective position.

BRIEF DESCRIPTION OF THE DRAWINGS

The exemplary embodiment of the invention which is illustrated in the drawings and the inventive method are discussed in greater detail hereinafter.

In the drawings.

DETAILED DESCRIPTION

Figure 1:
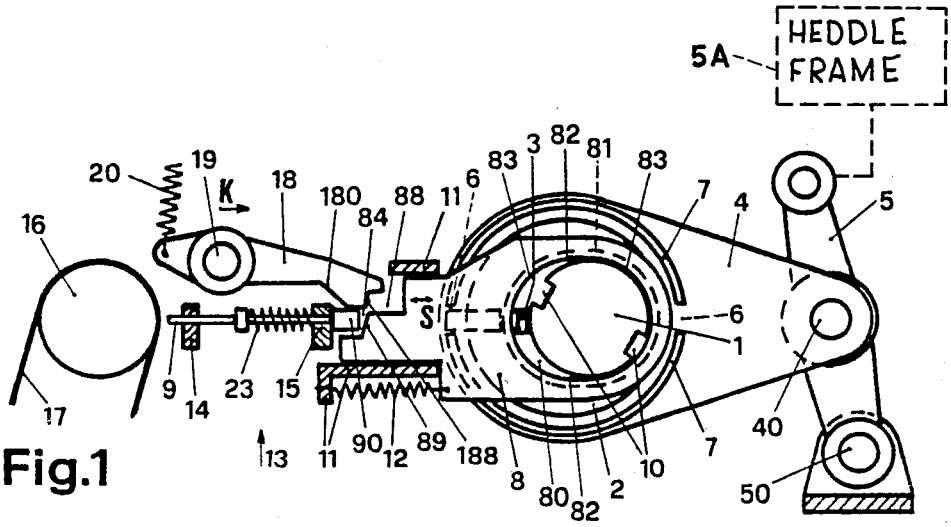
FIG. 1 is a diagrammatic side view of the shed-forming mechanism of a dobby which embodies the invention.
Figure 2:
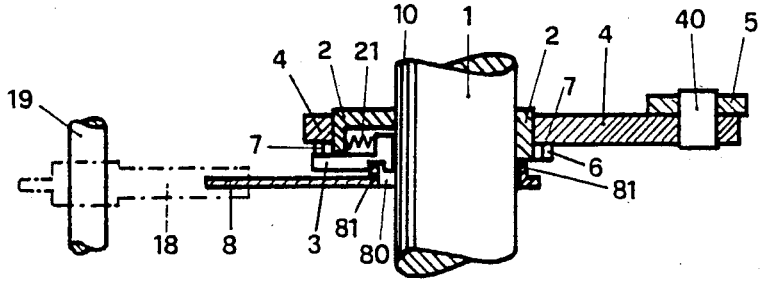
FIG. 2 is a fragmentary sectional top view of the shed-forming mechanism of FIG. 1, with a part of the needle mechanism omitted.

The basic design of a dobby which is connected to a weaving machine is described in greater detail in each of the patents which have been mentioned hereinabove.

An eccentric ring 2 is rotatably supported on the main drive shaft 1, which has two longitudinal grooves 10 which lie diametrically opposite one another, and a connecting rod 4 is rotatably supported on the eccentric ring 2. The eccentric ring 2 has a key 3 radially slidably supported thereon. A control lever 5, which is pivotally supported on the pivot pin 50 and is coupled in a conventional manner to a conventional heddle frame 5A of the weaving machine, is pivotally coupled by the pin 40 to the connecting rod 4, which carries two approximately semicircular guide rails 7, the ends of which each define a space or opening 6.

Spaced axially from the connecting rod 4, and within the axial thickness of the heddle frame, there is arranged a key-shifting gate 8 which has an oval opening 80 through which the drive shaft 1 extends. The gate 8 is supported for movement in two sliding guides 11 which assure a substantially rectilinear direction of movement S for the gate 8. When the key-shifting gate 8 is not otherwise controlled, it is pulled by a helical expansion spring 12, which has an end supported on the lower sliding guide 11, to the left toward the needle mechanism 13, which includes a reading needle 9 supported for lengthwise movement in a stationary guideway 14 and in a guideway 15 which carries out a back and forth movement substantially in the direction S. The reading needle 9, in front of which is provided a conventional control cylinder 16 and pattern card 17 having perforated and nonperforated control points, is approximately parallel to the sliding guides 11 of the dobby.

Between the key-shifting gate 8 and the needle mechanism 13, a pawl 18 which is pivotally supported on a support member or axle 19 is provided, whereby the axle 19 is supported for a limited amount of rectilinear movement in a direction of movement K which is substantially parallel to the direction of movement S of the key-shifting gate 8 in the guides 11. The side of the pawl 18 which faces a head 90 of the needle 9 has a ramp 180 which is urged by a tension spring 20 to pivot toward the needle head 90.

Figure 3:
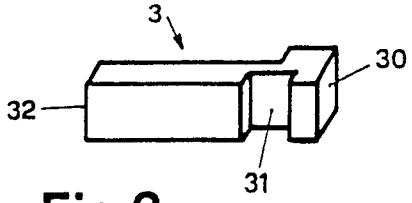
FIG. 3 is a respective view of a key which is a component of the shed-forming mechanism of FIG. 1.

The function of some parts, in particular the endless or closed cam 81 which extends around the opening 80 and is constructed as a collar which constantly engages the groove 31 of the key (FIG. 3), can be taken from U.S. Pat. No. 3,726,323.

A helical compression spring 21 is arranged between the key 3 and the eccentric ring 2 and urges the key 3 toward a position in which its end 30 engages one of the grooves 10 of the drive shaft 1 or engages the periphery of the drive shaft 1. The force of the spring 12 which moves the key-shifting gate 8 into its initial position is greater than that of the spring 21 for the key 3.

Contrary to the arrangement according to U.S. Pat. No. 3,726,323, the opening 80 in the key-shifting gate 8 is, according to the invention, oval-shaped, namely, it consists of two semicircular sections 83 which are connected by two straight sections 82 which are parallel to one another and extend approximately in the direction S of the sliding guides 11 for the key-shifting gate 8. The radii of the semicircles 83 are approximately the same as or slightly larger than the radius of the drive shaft 1. The sections 82 engage the periphery of the drive shaft 1 and serve to guide and prevent tilting of the key-shifting gate 8.

The operation of the device which is illustrated in the drawings is discussed in connection with all of the figures. The pattern card 17 which is supported on the cylinder 16 is indexed forward step-by-step by indexed rotation of the cylinder 16, and after each indexing movement the reading needle 9 through movement of the movable guideway 15 is moved toward the pattern card and, prior to further indexing of the pattern card, is moved back to its initial position.

Figure 4:
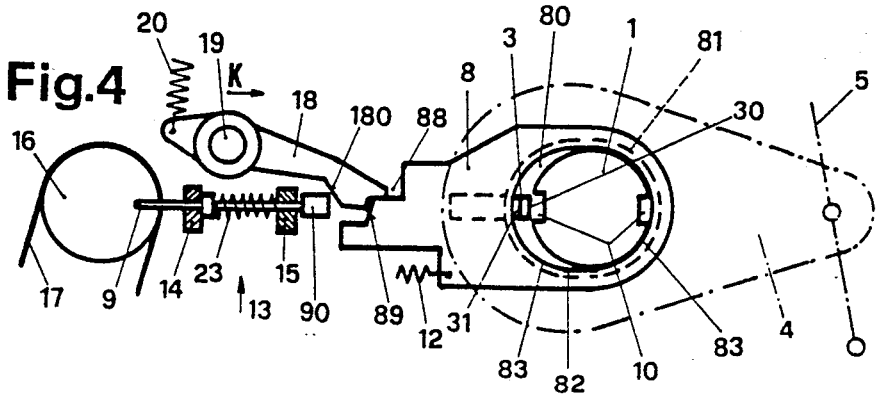
FIGS. 4 to 6 are diagrammatic side views similar to FIG. 1 which respectively illustrate three different operating positions of the shed-forming mechanism of FIG. 1.

The sequence of movement of the cylinder 16, the guideway 15, the axle 19 and the shaft 1 during each control operation is as follows. With the cylinder 16 and shaft 1 at a standstill, the shaft 1 being in the angular position shown in FIG. 4, the guideway 15 is moved a predetermined distance toward the cylinder 16. As the guideway 15 completes its movement toward the cylinder 16, or after such movement is completed, the axle 19 is moved in the direction K a predetermined distance. As the axle 19 completes this movement, or after it has completed this movement, the shaft 1 begins to rotate. As soon as the shaft 1 has started to rotate, the guideway 15 and axle 19 return to their initial positions. Thereafter, the cylinder 16 is indexed a predetermined angular amount. The shaft 1 is stopped when it has rotated 180°, and the sequence just described then repeats.

If the reading needle engages a nonperforated control point, it is pushed back relative to the member 15 against the force of the helical compression spring 23. The pawl 18 thus engages the head 90 of the needle 9 (FIG. 1), preventing the pawl 18 from pivoting in a clockwise direction. At approximately the end of the leftward reading movement of the needle 9, the axle 19 is moved, with the pawl 18, to the right in the direction of the arrow K. Since the tip of the pawl 18 engages the head of the needle 9 and prevents it from pivoting, movement of the axle 19 relative to the gate 8 causes the tip of pawl 18 to move into the space or recess 88 of the shifting gate 8, and the gate 8 thus remains in the initial position to which it was moved by the spring 12. The key 3 is thereby positioned by cooperation of the cam 81 and its groove 31 with its end 32 in the opening 6, so that its end 30 is not operatively engaged with the shaft 1 and the connecting rod 4, lever 5 and heddle frame 5A are not moved.

Figure 5:
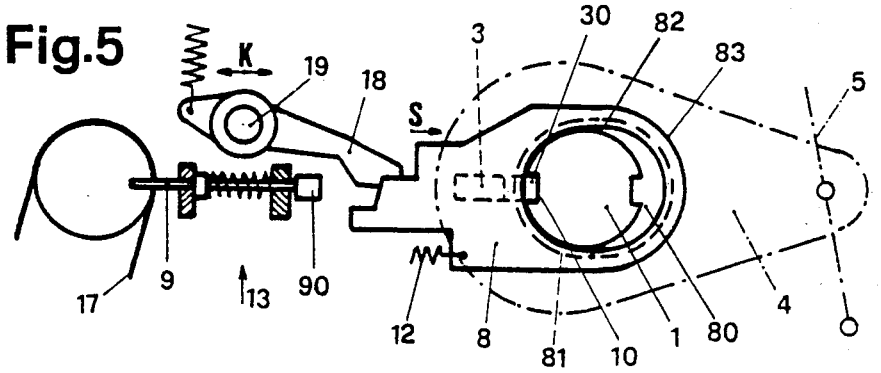

When the needle 9 engages a perforated control point during its reading movement, it extends through the pattern card 17 (FIGS. 4–6) and its head 90 no longer engages the pawl 18. The pawl tip is lowered in response to the urging of the tension spring 20 until it is positioned with its end surface 188 vertically aligned with the edge 89 of the shifting gate 8.

Between the end surface 188 of the pawl 18 and the edge 89 of gate 8 in this position there initially exists a space 84, which not only assures proper movement of the pawl tip, but also has the following function with respect to the sequence of operation. The adjustment of the oppositely directed, simultaneous or slightly phaseshifted or possibly speed-different movements of the needle 9 and axle 19 is made substantially easier by the space 84. Triggered by an impulse of a short duration, the axle 19 carries out a relatively rapid operating stroke in the direction of the arrow K from the position FIG. 4 to the position FIG. 5, which causes the pawl 18 to engage and move the key-shifting gate 8 in the direction of the arrow S against the force of the spring 12. This movement is made possible by the drive shaft 1 being disposed in the oval opening 80 in the key-shifting gate 8. The key 3 is taken along with the gate 8 due to engagement of the cam 81 with the groove 31 in the key, so that the end 32 moves out of the opening 6 in the guide rails 7 and the end 30 engages one of the grooves 10 of the drive shaft 1. The drive shaft is intermittently rotated in steps of 180°. During the control movement of the key-shifting gate 8, the shaft stands still and then rotates 180° after the control of the key 3. During this 180° rotation of the drive shaft 1, the key 3 is taken along due to its engagement in the groove 10, whereas if it were not engaged in the groove 10 the key would stand still and slidingly engage with its wide end 30 the peripheral surface of the drive shaft 1. Shortly after the start of this 180° rotation of the drive shaft, in the case in which the key-shifting gate 8 holds the key 3 in its controlled position (FIG. 5), the axle 19 is moved to its initial position, which frees the pawl 18 of engagement with the gate 8 and thus permits free positioning of the gear-shifting gate 8. During the rotation of the drive shaft through 180°, the key-shifting gate 8 is progressively moved by the spring 12 to the left into its initial position, whereby the key-shifting gate 8 slides on the one hand in the sliding guides 11 and on the other hand with its straight sections 82 on the drive shaft 1.

Figure 6:
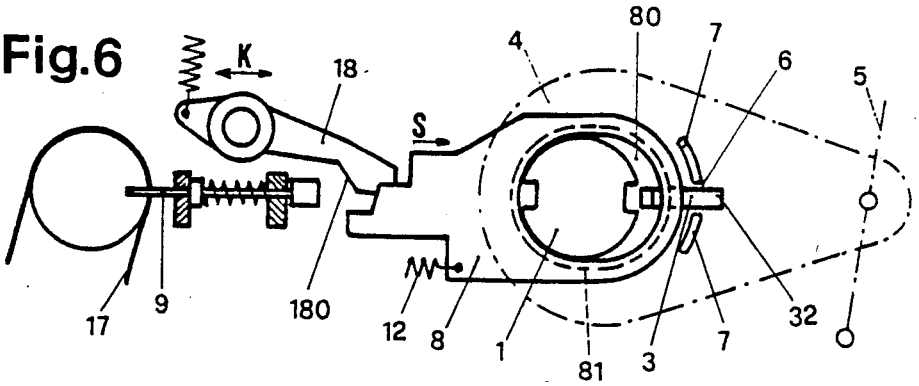

The key 3 is thereby constantly engaged with the groove 10 as the shaft 1 rotates 180°. After this movement, the heddle frame is in its upper-shed position. If it is supposed to remain in the upper-shed position for the next pick insertion, the next control point on pattern card 17 must be another perforation. As illustrated in FIG. 6, the needle 9 then extends through the pattern card 17 and into the control cylinder 16 and the pawl 18 tilts so that surface 188 will again engage the edge 89 of the shifting gate 8. During movement of the axle 19 in the direction K, the key 3 is taken along by the cam 81 of the moving key-shifting gate 8 and the key end 32 is moved into the opening 6, which results in the position according to FIG. 6. The drive shaft 1 now rotates without taking the key 3 along.

During moving back of the axle 19 shortly after the start of the rotation of the shaft 1, the key sits with its end 30 on the periphery of the drive shaft 1 but remains in the illustrated angular position until the second groove 10 is aligned with it, after which a new control operation is initiated by the pattern card. When the key 3 engages the peripheral surface of the drive shaft 1 during rotation of the shaft, the key-shifting gate 8 is held by engagement of the cam 81 and groove 31 of the key from being immediately pulled back into its initial position by the spring 12.

If the needle 1 reads a nonperforated control point, a movement of the key-shifting gate 8 does not take place, since the pawl 18 is not pivoted and does not engage and move the key-shifting gate 8.

An important characteristic of the described rotation dobby is that the paths of movement of the various control members for the key 3 all extend substantially rectilinearly and preferably parallel to the direction of movement of the needle 9.

In order to first sense the preceding and then the new pick, which according to a conventional dobby assures the correct pick-sequence function of the dobby, it is possible to arrange two pawls and two reading needles per stroke unit with appropriate time shifted reading and movement times.

The close support of the key-shifting gate 8 in the sliding guides 11 which are provided outside the range of movement of the connecting rod 4 and also the engagement of the straight sections 82 on the drive shaft 1 permit a sortening and extremely simple design of the key-shifting gate without a loss of stability. Through the interpositioned pawl 18, the control path of the needle and also that of the key-shifting gate are kept short, whereby through the small mass-accelerating forces which result, a significant increase in the speed of the dobby is achieved.

Through Swiss Patent No. 621 157, it has become known in a dobby of the Hattersley system to let the control mechanism act in reversed direction, but this is effected only by means of a complicated lever arrangement. In the aforedescribed inventive device, this reversal is achieved in a rotating dobby with only a few structural elements.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A device for the patternlike control of the key of a rotation dobby, comprising a rotatably supported drive shaft which has two axially extending grooves, on which drive shaft there is rotatably supported an eccentric ring which has a radially movable control key supported thereon, and on the eccentric ring is rotatably supported a connecting rod having two locking openings which the control key can engage and which lie diametrically opposite one another, wherein the connecting rod acts through a lever arrangement onto a heddle frame of a weaving machine, and including a needle mechanism having at least one movably supported reading member which reads a pattern card and controls an operating lever which in turn controls movement of a key-shifting gate having an opening which is closed peripherally and through which said drive shaft extends, wherein along the edge of the opening there is arranged a projecting collar which operatively engages and serves as a closed cam for controlling radial movement of the key, the key-shifting gate being supported in a rectilinear sliding guide for movement radially with respect to the drive shaft.

2. The device according to claim 1, wherein the operating lever is movably supported on a support member which is movable in a direction approximately parallel to the direction of movement of the key-shifting gate, and wherein the operating lever can carry out a control movement in a direction which extends transversely with respect to the direction of movement of the support member.

3. The device according to claim 2, wherein between an end surface of the operating lever and an edge of the key-shifting gate which is to be pushed by the surface on the operating lever, a space exists at the moment of the control movement of the operating lever.

4. The device according to claim 2, wherein the operating lever is pivotally supported and has an inclined surface in the region of a path of movement of the reading member, which is a reading needle.

5. The device according to claim 1, wherein the inner circumference of the opening in the key-shifting gate includes two semicircular sections connected by two straight sections which are approximately parallel to one another, and wherein the straight sections extend approximately in the direction of movement of the key-shifting gate.

6. The device according to claim 5, wherein the straight sections of the opening engage the peripheral surface of the drive shaft.

7. The device according to claim 5, wherein the straight sections extend approximately parallel to the direction of movement of the reading member, which is a reading needle.

8. The device according to claim 5, wherein the radii of the semicircular sections are approximately equal to or slightly larger than the radius of the drive shaft.

9. The device according to claim 2, wherein a spring is operatively coupled to a housing of the dobby and the key-shifting gate and urges the gate in a direction opposite to the direction of movement of the support member for the operating lever.

10. The device according to claim 1, wherein the control key is movable relative to the eccentric ring between a radially inner position in which the control key engages a respective one of the grooves in the drive shaft and a radially outer position in which the control key engages a respective one of the locking openings in the connecting rod, wherein the collar on the key-shifting gate projects axially from the key-shifting gate and extends completely around the opening therein, wherein the control key has a groove therein which slidably receives the collar, and wherein the locking openings on the connecting rod lie along a line extending substantially parallel to the direction of movement of the key-shifting gate.

11. The device according to claim 10, including: first resilient means yieldably urging movement of the key-shifting gate in a first direction in the rectilinear sliding guide; a pattern card; a reading needle which is the reading member, which extends substantially parallel to the first direction, and which is movable from an initial position toward the pattern card in the first direction, the reading needle stopping in a first position when it is aligned with a nonperforated location on the pattern card and moving beyond its first position to a second position when it is aligned with a perforation on the pattern card; a support member which is movable in a second direction substantially opposite the first direction and which has the operating lever movably supported thereon, the operating lever being movable between first and second positions, movement of the support member in the second direction when the lever is in its second position causing a portion of the lever to engage the key-shifting gate and to move the key-shifting gate in the second direction against the urging of the first resilient means, such portion of the lever being free of engagement with the key-shifting gate during movement of the support member in the second direction when the lever is in its first position, and means responsive to the position of the reading needle for moving the lever to one of its first and second positions when the reading needle is in its first position and for moving the lever to the other of its first and second positions when the reading needle is in its second position.

12. The device according to claim 11, wherein the support member is an axle extending substantially parallel to the drive shaft, wherein the operating lever is pivotally supported on the axle, and wherein the means for moving the lever in response to the position of the reading needle includes second resilient means yieldably urging movement of the lever toward its second position and includes a surface on the reading needle which can slidably engage a surface on the lever, the lever being in its first and second positions when the reading needle is respectively in its first and second positions.

* * * * *